US009759034B2

(12) United States Patent
King et al.

(10) Patent No.: US 9,759,034 B2
(45) Date of Patent: Sep. 12, 2017

(54) FRAC PLUG BODY

(75) Inventors: James G. King, Kingwood, TX (US); Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 1082 days.

(21) Appl. No.: 13/452,521

(22) Filed: Apr. 20, 2012

(65) Prior Publication Data

US 2013/0277044 A1 Oct. 24, 2013

(51) Int. Cl.
*E21B 33/12* (2006.01)
*E21B 33/129* (2006.01)
*E21B 43/26* (2006.01)

(52) U.S. Cl.
CPC ..... *E21B 33/12* (2013.01); *E21B 33/1294* (2013.01); *E21B 43/26* (2013.01)

(58) Field of Classification Search
USPC ..... 166/133, 135, 192, 195; 138/40
See application file for complete search history.

(56) References Cited

U.S. PATENT DOCUMENTS 3,572,435 A * 3/1971 Prescott, Jr. ..... 166/214
4,049,052 A * 9/1977 Arendt ..... E21B 34/105 166/183
5,580,622 A * 12/1996 Lockshaw et al. ..... 428/34.1
6,394,180 B1 5/2002 Berscheidt et al.
6,491,116 B2 12/2002 Berscheidt et al.
7,740,079 B2 6/2010 Clayton et al.
8,662,162 B2 * 3/2014 Kellner et al. ..... 166/194
2007/0017683 A1 * 1/2007 O'Malley ..... E21B 33/126 166/387
2008/0164027 A1 * 7/2008 Sanchez ..... E21B 43/14 166/278
2008/0271898 A1 11/2008 Turley et al.
2011/0030954 A1 * 2/2011 Allison et al. ..... 166/285
2011/0048740 A1 * 3/2011 Ward et al. ..... 166/381
2011/0240295 A1 10/2011 Porter et al.
2011/0290473 A1 12/2011 Frazier
2011/0315403 A1 12/2011 Nard et al.
2012/0073827 A1 * 3/2012 Kenyon et al. ..... 166/373

* cited by examiner

*Primary Examiner* — David Andrews
*Assistant Examiner* — Tara Schimpf
(74) *Attorney, Agent, or Firm* — Steve Rosenblatt

(57) ABSTRACT

A frac plug mandrel assembly has an inner core that permits flow that is surrounded by a thin wall tube that distributes compressive loading, such as that applied by the set sealing element to the core. The core is a cylindrically shaped insert for inside the tube and allows flow until a ball or plug is landed on a seat to close off the flow through the core. The core can have a star pattern with a series of radially extending segments from a solid hub or a cylindrical shape of a honeycomb or other porous structure that has the requisite strength to resist collapse from compressive loading of the set sealing element while still allowing sufficient flow area for fluid displacement.

19 Claims, 4 Drawing Sheets

FRAC PLUG BODY

FIELD OF THE INVENTION

The field of the invention is frac plugs and more particularly plugs that have a more economical mandrel design with a flow through structure that has the ability to withstand compressive collapse loads from the surrounding set seal.

BACKGROUND OF THE INVENTION

Fracturing is commonly done is horizontal or nearly horizontal completions. Initially the toe of the well is perforated and fractured. After that a frac plug with a perforating gun are run together and the plug is set with a known setting tool secured to it which then releases from it. The gun is released from the set plug and shot. The previously fractured zone at the toe of the well is isolated by pumping a ball to the set frac plug after the gun has been tripped out. The frac plug typically has a passage through a tubular mandrel and a seat for a ball or a dart to land on and obstruct the zone below that has already been fractured. The next zone above the toe is then fractured and the process is repeated until the entire interval has been fractured. The well can then be put into production.

The structure and operation of a known frac plug design is described below in association with FIGS. 1-3.

The operation of frac plug 10 is as follows. Frac plug 10 may be lowered into the wellbore 25 utilizing a setting tool of a type known in the art. As is depicted schematically in FIG. 1, one, two or several frac plugs or downhole tools 10 may be set in the hole. As the frac plug 10 is lowered into the hole, flow therethrough will be allowed since the spring 82 will prevent sealing ball 38 from engaging ball seat 50, while ball cage 36 prevents sealing ball 38 from moving away from ball seat 50 any further than upper end cap 90 will allow. Once frac plug 10 has been lowered to a desired position in the well 20, a setting tool of a type known in the art can be utilized to move the frac plug 10 from its unset position 32 to the set position 15 as depicted in FIGS. 2 and 3, respectively. In set position 15 slip segments 56 and expandable packer elements 66 engage casing 30. It may be desirable or necessary in certain circumstances to displace fluid downward through ports 92 in ball cage 36 and thus into and through longitudinal central flow passage 48. For example, once frac plug 10 has been set it may be desirable to lower a tool into the well, such as a perforating tool, on a wire line. In deviated wells it may be necessary to move the perforating tool to the desired location with fluid flow into the well. If a sealing ball has already seated and could not be removed therefrom, or if a bridge plug was utilized, such fluid flow would not be possible and the perforating or other tool would have to be lowered by other means.

When it is desired to seat sealing ball 38, fluid is displaced into the well at a predetermined flow rate which will overcome a spring force of the spring 82. The flow of fluid at the predetermined rate or higher will cause sealing ball 38 to move downwardly such that it engages ball seat 50. When sealing ball 38 is engaged with ball seat 50 and the plug 34 is in its set position 15, fluid flow past frac plug 10 is prevented. Thus, slurry or other fluid may be displaced into the well 20 and forced out into a formation above frac plug 10. The position shown in FIG. 3 may be referred to as a closed position 94 since the longitudinal central flow passage 48 is closed and no flow through frac plug 10 is permitted. The position shown in FIG. 2 may therefore be referred to as an open position 96 since fluid flow through the frac plug 10 is permitted when the sealing ball 38 has not engaged ball seat 50. As is apparent, sealing ball 38 is trapped in ball cage 36 and is thus prevented from moving upwardly relative to the ball seat 50 past a predetermined distance, which is determined by the length of the ball cage 36. The spring 82 acts to keep the sealing ball 38 off of the ball seat 50 such that flow is permitted until the predetermined flow rate is reached. Ball cage 36 thus comprises a retaining means for sealing ball 38, and carries sealing ball 38 with and as part of frac plug 10, and also comprises a means for preventing sealing ball 38 from moving upwardly past a predetermined distance away from ball seat 50.

When it is desired to drill frac plug 10 out of the well, any means known in the art may be used to do so. Once the drill bit 13 connected to the end of a tool string or tubing string 16 has gone through a portion of the frac plug 10, namely the slip segments 56 and the expandable packer elements 66, at least a portion of the frac plug 10, namely the lower end 14 which in the embodiment shown will include the mule shoe 70, will fall into or will be pushed into the well 20 by the drill bit 13. Assuming there are no other tools therebelow, that portion of the frac plug 10 may be left in the hole. However, as shown in FIG. 1, there may be one or more tools below the frac plug 10. Thus, in the embodiment shown, ceramic buttons 93 in the upper frac plug 10*a* will engage the upper end 12 of lower frac plug 10*b* such that the portion of upper frac plug 10*a* will not spin as it is drilled from the well 20. Although frac plugs 10 are utilized in the foregoing description, the ceramic buttons 93 may be utilized with any downhole tool such that spinning relative to the tool therebelow is prevented.

The mandrel that has the ball seat 50 that accepts the ball 38 is typically a filament wound composite tube with a wall thickness sufficient to resist collapse in the set position when the seal 66 is against the surrounding tubular in a compressed condition and retained by the slips 56, 57. The tubular mandrel is preferably made of readily drillable materials but in order to meet its structural requirements when the frac plug is set winds up being a significant cost driver in the cost of fabrication of the frac plug assembly. While frac plug designs can vary, as illustrated in U.S. Pat. Nos. 6,394,180; 6,491,116; 7,740,079; US Publication 2008/0271898; 2011/0290473; 2011/0315403; 2011/0048740 and 2011/0240295, they all need to meet the requirement of allowing some flow through the tools so that fluid displacement can occur and they all need the structural rigidity to resist collapse from pressure loading and the set sealing element.

Numerous frac plugs can be used in a given well and as a result they are used in large quantities throughout the world and have approached the status of a commodity product with very competitive pricing. Accordingly it is desirable to reduce the manufactured cost of these plugs and the present invention addresses this issue by providing design alternatives to the most expensive component which is the mandrel and associated ball seat. Rather than the prior designs of a relatively thick wall tubular the present invention envisions a porous internal structure that has substantial capacity to resist compressive loading that can then be surrounded with a thinner outer tubular that merely acts to distribute the compressive loading that is borne by the internal structure. Various internal structures are envisioned such as a star pattern of a series of radially extending members from a central solid hub, a honeycomb cylindrical shape or a screw shape defining a helical flow path, among other variations. Those skilled in the art will more readily appreciate other aspects of the invention from a review of the description of the preferred embodiment and the associated drawings while understanding that the full scope of the invention is to be determined from the appended claims.

SUMMARY OF THE INVENTION

A frac plug mandrel assembly has an inner core that permits flow that is surrounded by a thin wall tube that distributes compressive loading, such as that applied by the set sealing element to the core. The core is a cylindrically shaped insert for inside the tube and allows flow until a ball or plug is landed on a seat to close off the flow through the core. The core can have a star pattern with a series of radially extending segments from a solid hub or a cylindrical shape of a honeycomb or other porous structure that has the requisite strength to resist collapse from compressive loading of the set sealing element while still allowing sufficient flow area for fluid displacement.

BRIEF DESCRIPTIONS OF THE DRAWINGS

FIGS. 1A and 1B schematically show two downhole tools of a prior art tool positioned in a wellbore with a drill bit disposed above;

DETAILED DESCRIPTION OF THE PREFERRED EMBODIMENT

The present invention seeks to replace the thick wall of a tubular mandrel that is usually made of a filament wound composite structure with an alternative structure that meets the performance criteria but is significantly more economical to produce. The performance criteria include the ability to allow flow through the mandrel so that a ball or plug can be rapidly deployed to a seat in horizontal or near horizontal completions. The structure has to resist collapse from the set seal of the frac plug and the material for the assembly has to be readily drillable so that the frac plugs can all be milled up and the cuttings circulated to the surface after the fracturing of the zone of interest is concluded. Since the focus of the invention is on the mandrel structure of an otherwise known frac plug structure as described above, the drawings will illustrate the mandrel structure only, with those skilled in the art recognizing that the mandrel assembly of the present invention is intended for use in such known frac plug structures, thereby allowing such details to be omitted from drawings of the invention.

Figure 1A:
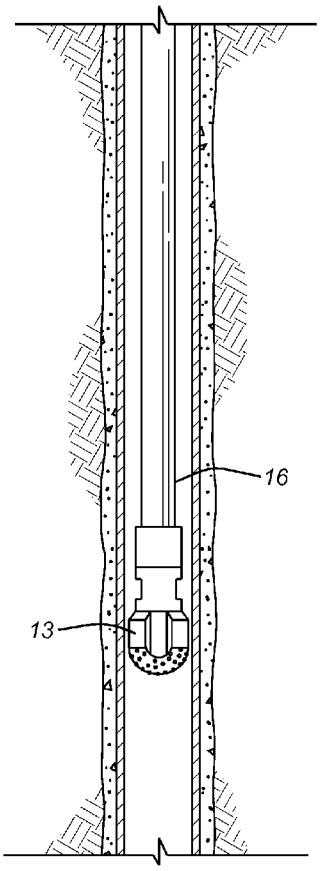
(PRIOR ART) FIG. 1A
Figure 1B:
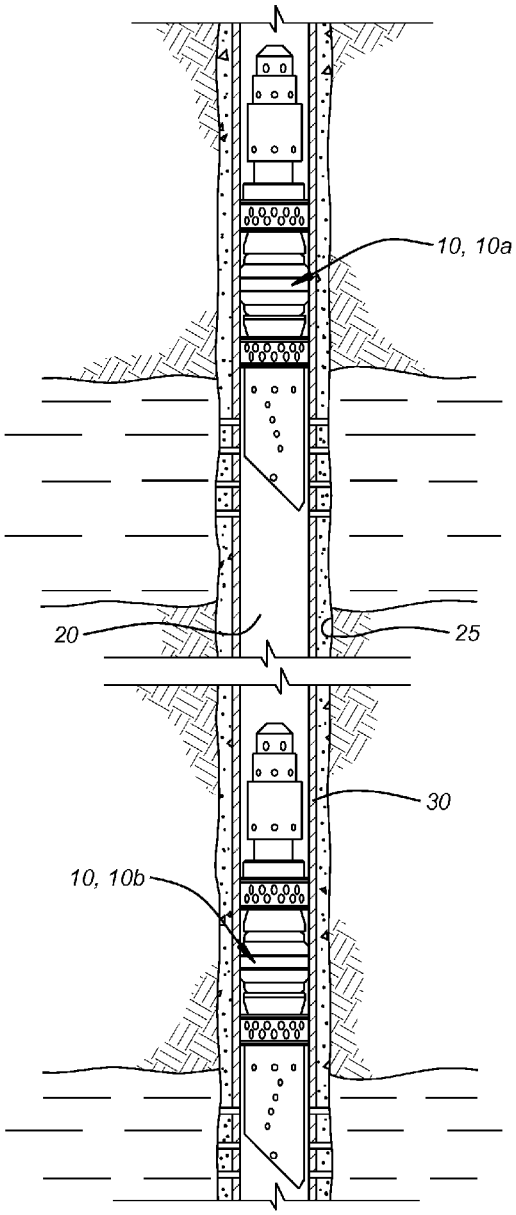
(PRIOR ART) FIG. 1B
Figure 2:
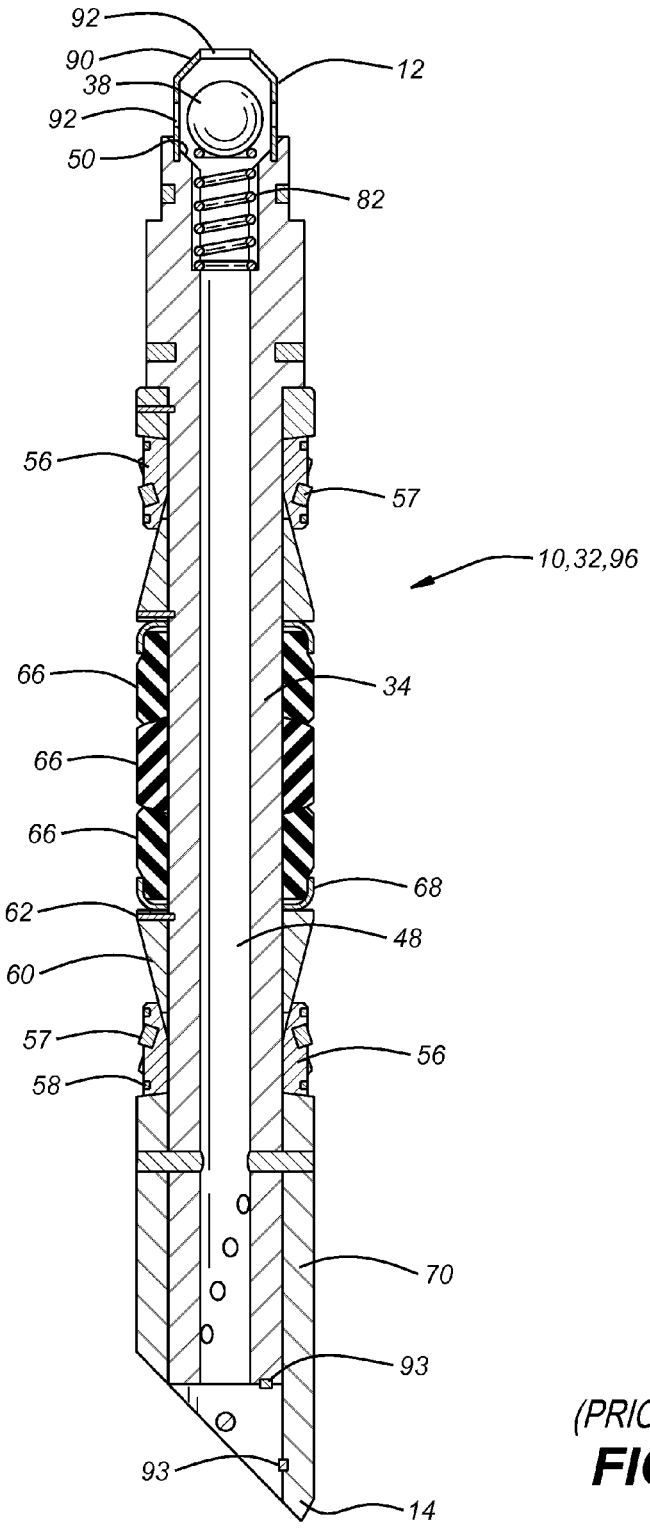
(PRIOR ART) FIG. 2
FIG. 2 shows a cross-section of a prior art frac plug.
Figure 3:
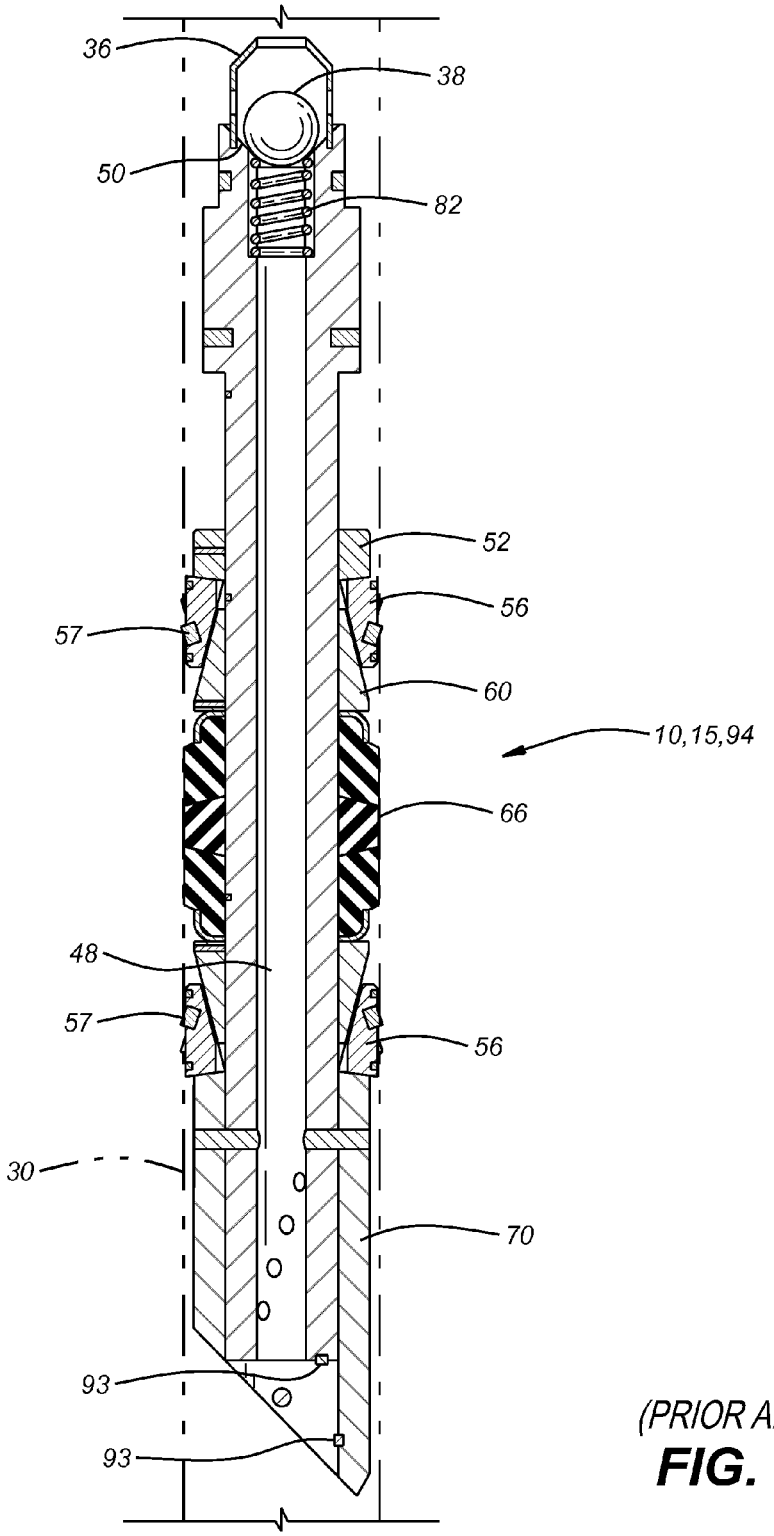
(PRIOR ART) FIG. 3
FIG. 3 is a cross-sectional view of a prior art frac plug in the set position with the slips and the sealing element expanded to engage casing or other pipe in the wellbore.
Figure 4:
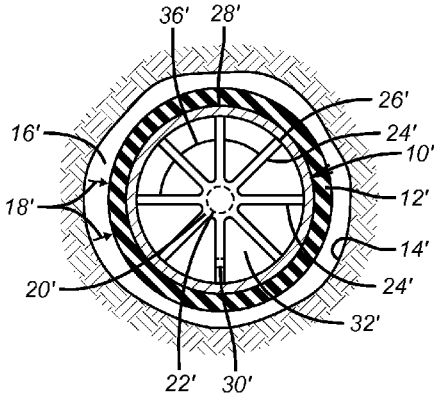
FIG. 4 is a section view of one alternative mandrel structure of the present invention showing a star pattern from a solid hub.

FIG. 4 illustrates a mandrel assembly 10' seen in section through the sealing element 12' and showing the wellbore 14' which is normally either cased or lined but could be open hole. The gap 16' indicates that the sealing element 12' has yet to be energized into contact with the wellbore 14'. Once that occurs the mandrel assembly 10' is placed under compressive loading shown schematically as arrows 18'. The compressive loading is generally in a radial orientation toward the hub 20'. Hub 20' is preferably solid but can have a hollow core represented by broken line 22'. A series of radially extending ribs 24' extend for the height of the assembly 10' and can be axially continuous or discontinuous. The ends 26' can be flat or radiused to match the inside radius of the surrounding tube 28'. The ribs 24' can also be integral with the tube 28'. Tube 28' is there for the purpose of load distribution as between adjacent pairs of ribs 24'. Depending on the spacing of the ribs, which to some extent is controlled by the expected flow rate through the assembly 10' when delivering a ball or plug; it is possible to optionally eliminate the tube 28'. The height of the assembly 10 will control the spacing of the ribs 24'. The ribs 24' can also have perforations 30' to reduce flow resistance if the rib 24' spacing is reduced, without materially reducing the column strength of each rib under radial loading represented by arrows 18' when the seal 12' is against the surrounding tubular 14'. It should be noted that applied differential pressure to the frac plug with the seal 12' set and the flow passages 32' obstructed by an object will also add a compressive force to the assembly 10' that will need to be resisted to prevent collapse. The traditional seat 34' that accepts an object like a ball or dart in the known manner can still be used. Those skilled in the art will appreciate that such a seat 34' can be supported by the ribs 24' and can optionally be surrounded by the tube 28' that can go for the full length of the assembly 10' or for a shorter distance simply surrounding the seat 34'. While the ribs 24' are shown disposed in a plane going through the hub 20' the invention also encompasses a helical orientation for each rib to enhance the buckling resistance of each rib 24'. Lateral bracing between ribs 24' such as with ring segments between ribs or a solid 360 ring such as is shown schematically as 36' is also contemplated. Preferably all the components are readily drillable using a host of materials previously used for frac plug components such as plastics, fiberglass or composites to name a few.

Figure 5:
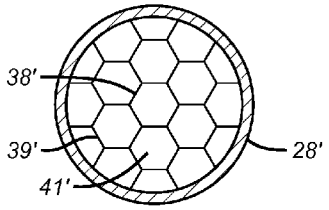
FIG. 5 is an alternative to FIG. 4 showing a honeycomb core.

FIG. 5 shows an alternative design with the same optional tube 28' but with the core structure 38' being a honeycomb akin to the structure in a beehive but made of an easily drillable material. While hexagonal passages 39' are illustrates other shapes are contemplated. The passages 41' can be straight through or can define a more indirect network of flow paths. FIG. 5 is intended to be schematic and is also intended to illustrate other structures that can be formed into a cylindrical shape that can act as a structural support while permitting flow therethrough such as fused spheres, randomly extending spikes, webbed structures and layered drillable screen materials that can be joined or fused together to make a cohesive generally cylindrical shape that can be inserted into a surrounding tubular shell that is also drillable in the form of tube 28'. As before with FIG. 4, the tube 28 can be optionally omitted. Landing an object on a seat such as 34' shown in FIG. 7 will block the flow through the structure 38' so that the fracturing can take place.

Figure 6:
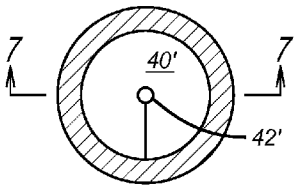
FIG. 6 is an alternative to FIG. 4 showing a helical screw for the core.
Figure 7:
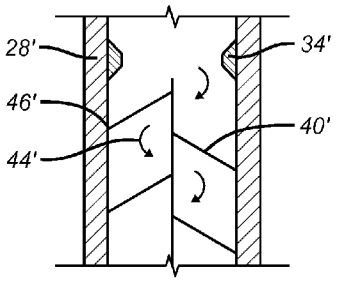
FIG. 7 is the view at line 7-7 of FIG. 6.

FIGS. 6 and 7 show a helix 40' supported on an optional central hub 42'. The space between the flights creates a circular flow passage 44' as highlighted by the arrows in FIG. 7. The pitch of the flights can be constant or can change along the length. The peripheral edges 46' can be up against a tube such as 28' or such a tube can be optionally omitted. The helical shape accomplishes the creation of a flow path at the same time in a structure that has heightened collapse resistance due to the helix shape.

Even if a tube such as 28' is used it can be dramatically thinner than existing tubular mandrel wall thickness used in an open tube structure. The wall thickness can be decreased to about a quarter of the former thickness for the same inside diameter or more. In fact, in some embodiments the tube can be eliminated for a flow through core design that can still be isolated in the known manner with an object pumped to a seat associated with the core to obstruct flow sufficiently for isolation of the already fractured interval as the interval above is fractured. In making the assembly 10 the core can be made first and machined to substantially cylindrical shape with rough edges smoothed down. The surrounding tube can be filament wound around the manufactured core.

The above description is illustrative of the preferred embodiment and many modifications may be made by those skilled in the art without departing from the invention whose scope is to be determined from the literal and equivalent scope of the claims below:

We claim:

1. A mandrel assembly for a frac plug for subterranean use, comprising:

a tubular mandrel comprising a wall having a longitudinal axis and an outer peripheral surface on said wall supporting a sealing element selectively radially extendable into engagement with a surrounding tubular or a borehole wall to create a compressive reaction force thereon and an inner peripheral surface on an opposite side of said wall defining a wall thickness therebetween, said inner peripheral surface extends from a first end to a second end of said mandrel defining a passage that incorporates a central axis of said mandrel to define a flow space about said central axis;

said mandrel having a seat around said passage for selective closing of said passage with an object forced to said seat with fluid pressure in a borehole extending to the subterranean location;

said passage further incorporates interconnected spaced structural members transversely spanning said passage for the substantial length of said sealing element and further spanning the central axis of said mandrel to opposed fixed contact of said inner peripheral surface such that said spaced structural members resist collapse force transmitted through said spaced structural members through said opposed fixed contact of said inner peripheral surface said structural members defining at least one fluid path through said passage between or among said structural members defined between said longitudinal axis and said inner peripheral surface.

2. The assembly of claim 1, wherein:

said structural members comprise a cylindrically shaped core surrounded by said mandrel.

3. The assembly of claim 1, wherein:

said structural members comprise a hub with a plurality of ribs.

4. The assembly of claim 3, wherein:

said ribs are disposed in a plane that goes through said axis.

5. The assembly of claim 3, wherein:

said hub is hollow.

6. The assembly of claim 3, wherein:

said ribs have ends that contact said inner peripheral surface of said mandrel that are flat or arcuate.

7. The assembly of claim 3, wherein:

said ribs are integrated with said inner peripheral surface of said mandrel.

8. The assembly of claim 3, wherein:

adjacent ribs are circumferentially braced in a transverse plane to said axis.

9. The assembly of claim 3, wherein:

said ribs have openings along their length.

10. The assembly of claim 1, wherein:

said structural members have a honeycomb structure defining a plurality of through passages.

11. The assembly of claim 1, wherein:

said at least one fluid path is straight through said structural members.

12. The assembly of claim 1, wherein:

said structural members are defined by randomly shaped objects joined together to define flow passages through said passage.

13. The assembly of claim 12, wherein:

said objects comprise spheres, rods, or mesh.

14. The assembly of claim 1, wherein:

said structural members comprise a helix.

15. The assembly of claim 14, wherein:

said helix is built around a core.

16. The assembly of claim 14, wherein:

said helix is made of a plurality of flights on a constant pitch or a plurality of pitches.

17. A mandrel assembly for a frac plug for subterranean use, comprising:

a tubular mandrel comprising a wall having a longitudinal axis and an outer peripheral surface on said wall supporting a sealing element selectively extendable into engagement with a surrounding tubular or a borehole wall to create a compressive reaction force thereon and an inner peripheral surface on an opposite side of said wall, said inner peripheral surface defining a passage that is circular in cross-section to define a cylindrical space about said axis, said passage further comprising spaced structural members extending radially from said longitudinal axis to said inner peripheral surface, said structural members having a height extending the majority of the height of said sealing element while defining at least one fluid path through said passage between or among said structural members;

said structural members comprise a hub with a plurality of ribs;

said ribs define helical paths about said axis.

18. A method for completing a wellbore using at least one frac plug, comprising:

delivering at least one frac plug to a subterranean location in a formation through the wellbore, said at least one frac plug comprising a tubular mandrel comprising a wall having a longitudinal axis and an outer peripheral surface on said wall supporting a sealing element selectively radially extendable into engagement with a surrounding tubular or a borehole wall to create a compressive reaction force thereon and an inner peripheral surface on an opposite side of said wall defining a wall thickness therebetween, said inner peripheral surface extends from a first end to a second end of said mandrel defining a passage that incorporates a central axis of said mandrel to define a flow space about said central axis;

said mandrel having a seat around said passage for selective closing of said passage including at said central axis thereof with an object forced to said seat with pressure in a borehole extending to the subterranean location;

said passage further incorporates interconnected spaced structural members transversely spanning said passage for the substantial length of said sealing element and further spanning the central axis of said mandrel to opposed fixed contact of said inner peripheral surface such that said spaced structural members resist collapse force transmitted through said spaced structural members through said opposed fixed contact of said inner peripheral surface, said structural members defining at least one fluid path through said passage between or among said structural members defined between said longitudinal axis and said inner peripheral surface;

maintaining said passage open during said delivering;

obstructing said passage with said object after said sealing element is extended to the surrounding tubular or borehole wall.

19. The method of claim 18, comprising:

fracturing the formation;

milling out the frac plug after said fracturing.

* * * * *